US008979437B2

(12) United States Patent
Freitag

(10) Patent No.: US 8,979,437 B2
(45) Date of Patent: Mar. 17, 2015

(54) REINFORCED STRUCTURES IN THE GROUND

(75) Inventor: Nicolas Freitag, Orsay (FR)

(73) Assignee: Terre Armee Internationale, Velizy Villacoublay (FR)

( * ) Notice: Subject to any disclaimer, the term of this patent is extended or adjusted under 35 U.S.C. 154(b) by 0 days.

(21) Appl. No.: 14/005,503

(22) PCT Filed: Mar. 30, 2012

(86) PCT No.: PCT/FR2012/050694

§ 371 (c)(1), (2), (4) Date: Sep. 16, 2013

(87) PCT Pub. No.: WO2012/131273

PCT Pub. Date: Oct. 4, 2012

(65) Prior Publication Data

US 2014/0003869 A1 Jan. 2, 2014

(30) Foreign Application Priority Data

Mar. 30, 2011 (FR) ..... 11 52639

(51) Int. Cl.

| | |
|---|---|
| ***E02D 17/20*** | (2006.01) |
| ***E02D 29/02*** | (2006.01) |
| ***E04C 5/12*** | (2006.01) |

(52) U.S. Cl.

CPC ..... *E02D 29/0233* (2013.01); *E02D 29/0241* (2013.01); *E04C 5/12* (2013.01); *E02D 17/20* (2013.01)

USPC ..... 405/262; 405/284

(58) Field of Classification Search

CPC ..... E02D 29/02; E02D 29/0225; E21D 21/00

USPC ..... 405/262, 284, 302.7

See application file for complete search history.

(56) References Cited

U.S. PATENT DOCUMENTS

| | | | | |
|---|---|---|---|---|
| 4,725,170 | A * | 2/1988 | Davis | 405/286 |
| 5,044,833 | A * | 9/1991 | Wilfiker | 405/267 |
| 5,525,014 | A * | 6/1996 | Brown | 405/262 |
| 5,807,030 | A | 9/1998 | Anderson et al. | |
| 8,393,829 | B2 * | 3/2013 | Taylor | 405/262 |
| 8,496,411 | B2 * | 7/2013 | Taylor | 405/284 |
| 2011/0229274 | A1 * | 9/2011 | Taylor | 405/262 |

FOREIGN PATENT DOCUMENTS

| | | |
|---|---|---|
| FR | 2939157 A1 | 6/2010 |
| WO | 9806907 A1 | 2/1998 |

(Continued)

*Primary Examiner* — Benjamin Fiorello

(74) *Attorney, Agent, or Firm* — McKenna Long & Aldridge LLP

(57) ABSTRACT

The invention relates to reinforced structures in the ground, including an embankment, a facing (4) placed along the front surface of the structure, an anchoring element (6) including a projecting element (8), which projects relative to an inner surface of the structure and an attachment element (10), and a stabilization element (12) including at least two longitudinal portions (14, 16) continuously connected together by an elbow portion (18), said elbow portion being delimited by a throat (20) forming, together with said elbow portion, an anchoring space suitable for receiving the attachment element of the anchoring element, the anchoring space and the attachment element being shaped so as to limit the movement of the stabilization element in every direction substantially parallel to the longitudinal direction of the stabilization element (12).

9 Claims, 2 Drawing Sheets

(56) References Cited

FOREIGN PATENT DOCUMENTS

| | | | |
|---|---|---|---|
| WO | 9858887 | A1 | 12/1998 |
| WO | 2006032785 | A2 | 3/2006 |
| WO | 2006032786 | A2 | 3/2006 |
| WO | 2010005117 | A1 | 1/2010 |

* cited by examiner

REINFORCED STRUCTURES IN THE GROUND

This application is a 35 U.S.C. §371 National Stage Entry of International Application No. PCT/FR2012/050694, filed Mar. 30, 2012 and claims the benefit of French Application No. 11 52639, filed Mar. 30, 2011, all of which are incorporated by reference in their entirety herein.

FIELD OF THE INVENTION

The present invention concerns reinforced earth structures and construction methods for reinforced earth structures.

BACKGROUND OF THE INVENTION

These structures traditionally comprise a facing, a backfill behind the facing, stabilization elements distributed within the backfill to provide mechanical stabilization, and a system to connect the stabilization elements and the facing.

The facing is made, for example, from prefabricated concrete elements in the form of slabs or blocks, said prefabricated elements being placed side by side to cover the front face of the structure. A structure created in this manner is known by the commercial name TerraClass®, from the company TERRE ARMEE INTERNATIONALE.

The facing can also be made of a grid, particularly consisting of metal rods welded together. Such a facing can include a geotextile and can be revegetated. A structure created in this manner is known by the commercial name TerraTrel®, from the company TERRE ARMEE INTERNATIONALE.

Various types of stabilization elements can be used in such reinforced earth structures.

Certain structures include metal stabilization elements comprising bars of galvanized steel. It is also possible to use stabilization elements such as stabilization bands made of synthetic material, for example based on polymer fibers.

The stabilization elements are placed in the earth at a density that depends on the forces which may be exerted on the structure, with the thrust from the earth absorbed by the friction between the soil/stabilization elements. The stabilization elements are attached to the facing and/or to a wall separated from the facing.

Here we are concerned with metal stabilization elements.

Metal stabilization elements are often considered advantageous in terms of mechanical efficiency, and can consist of metal bars welded together to form, for example, a ladder or mesh. A ladder-shaped stabilization element generally consists of two substantially parallel metal rods, each constituting a longitudinal portion, and crossbars which connect the longitudinal rods together to give rigidity to the assembly.

A stabilization element resembling a ladder is formed in this manner.

In general, one end of the stabilization element comprises a means of attachment to the facing.

In the embodiment illustrated in FIG. 55 of U.S. Pat. No. 5,807,030, the two ends of the longitudinal rods are connected by a flat, pierced part. The pierced portion of said part is intended for receiving the means of attachment to the facing.

This solution offers numerous advantages, including a single connection point which allows forcing the stabilization element to deviate from the perpendicular at the facing and balancing the stresses between the two longitudinal rods.

However, such a ladder is obtained by welding, to the two longitudinal rods, the flat part intended to receive the means of attachment to the facing. This manufacturing process is long and costly.

Other solutions have been described, particularly the use of a "hairpin"-shaped ladder such as, for example, the one described in FIG. 38 U.S. Pat. No. 5,807,030.

These hairpin ladders have the advantage of being composed of only one longitudinal rod bent into a hairpin shape, thus decreasing the mechanical weaknesses at the link to the facing.

However, this type of ladder is not compatible with the conventional connections used in facings.

In addition, when this type of ladder is connected to the facing using a bolt or a pin, there is some longitudinal play remaining. This longitudinal play can result in different stresses in the various ladders connected to the same facing element and can affect the safety and/or cost of these elements.

OBJECTS AND SUMMARY OF THE DISCLOSURE

One aim of the invention is to overcome the above disadvantages, and in particular to propose a stabilization element that does not have the disadvantages of prior art stabilization elements.

The invention therefore proposes a reinforced earth structure comprising:

- backfill,
- a facing placed along the front face of the structure,
- an anchoring element including a projecting element which projects relative to an inner face of the structure and an attachment element, and
- a stabilization element including at least two longitudinal portions continuously connected together by an elbow portion, said elbow portion being delimited by a neck in said longitudinal portions, said neck forming, together with said elbow portion, an anchoring space suitable for receiving the attachment element of the anchoring element, wherein the stabilization element is anchored to said inner face of the structure by placing the attachment element of the anchoring element in the anchoring space of the stabilization element, the anchoring space and the attachment element being shaped so as to limit the movements of the stabilization element in any direction substantially parallel to the longitudinal direction of the stabilization element.

Advantageously, in the reinforced earth structure of the invention, the longitudinal movements of the stabilization element are limited, which thus increases the reliability of the reinforced earth structure according to the invention.

A reinforced earth structure according to the invention may additionally include one or more of the following optional characteristics, individually or in any possible combination:

- the stabilization and attachment elements are configured so that the dimensions, in the longitudinal direction of the stabilization element, of the anchoring space of said stabilization element and of the attachment element of the anchoring element are substantially identical; and/or
- a space exists at the neck between said longitudinal portions of the stabilization element; and/or
- the stabilization element is formed so as to maintain a space at the neck between said longitudinal portions of the stabilization element; and/or
- the stabilization element comprises crosspieces connecting the longitudinal portions together; and/or
- the projecting element is in the form of a plate extending in a plane substantially perpendicular to the inner face of the structure; and/or the stabilization element comprises a flattened area at the anchoring space, said flattened area being at least partially in contact with the plate forming the projecting element; and/or the attachment element is a distinct mounted part; and/or the projecting element comprises two plates extending in planes substantially parallel to each other and perpendicular to the inner face of the structure, the stabilization element comprising a flattened area at the anchoring space, said flattened area being arranged between the two plates of the projecting element so as to be at least partially in contact with said plates; and/or the longitudinal portions are of metal, particularly galvanized steel, for example in the shape of cylindrical rods; and/or the crosspieces are of metal, particularly galvanized steel, for example shaped as cylindrical bars; and/or the elbow portion has the shape of a U or a V.

The invention also relates to a stabilization element suitable for stabilizing a reinforced earth structure according to the invention, comprising at least two longitudinal portions continuously connected together by an elbow portion, said elbow portion being delimited by a neck in said longitudinal portions, said neck forming, together with said elbow portion, an anchoring space suitable for receiving an attachment element so as to limit the movements of the stabilization element in any direction substantially parallel to the longitudinal direction of the stabilization element, wherein crosspieces connect the longitudinal portions together.

The invention also relates to a method for constructing a reinforced earth structure, wherein:

a facing is placed along a front face of the structure, delimiting a volume to be filled in, said facing including an anchoring element comprising a projecting element which projects relative to the rear face of the facing and an attachment element, a stabilization element is placed within an area of said volume, the stabilization element comprising at least two longitudinal portions continuously connected together by an elbow portion, said elbow portion being delimited by a neck in said longitudinal portions, said neck forming, together with said elbow portion, an anchoring space suitable for receiving the attachment element of the anchoring element, the stabilization element is anchored to the facing by placing the attachment element of the anchoring element in the anchoring space of the stabilization element, backfill material is placed within said volume and the backfill material is compacted, the anchoring space and the attachment element being shaped so as to limit the movements of the stabilization element in any direction substantially parallel to the longitudinal direction of the stabilization element.

The invention also relates to a method for constructing a reinforced earth structure in front of a preexisting wall including an anchoring element comprising a projecting element which projects relative to said wall and an attachment element, wherein:

a facing is placed along a front face of the structure, delimiting a volume to be filled in, a stabilization element is placed within an area of said volume, the stabilization element comprising at least two longitudinal portions continuously connected together by an elbow portion, said elbow portion being delimited by a neck in said longitudinal portions, said neck forming, together with said elbow portion, an anchoring space suitable for receiving the attachment element of the anchoring element, the stabilization element is anchored to the wall by placing the attachment element of the anchoring element in the anchoring space of the stabilization element, backfill material is placed within said volume and the backfill material is compacted, the anchoring space and the attachment element being shaped so as to limit the movements of the stabilization element in any direction substantially parallel to the longitudinal direction of the stabilization element.

BRIEF DESCRIPTION OF THE DRAWINGS

The invention will be better understood by reading the following description, provided solely for illustrative purposes and made with reference to the accompanying drawings in which.

MORE DETAILED DESCRIPTION

For clarity, the various elements represented in the figures are not necessarily to scale.

Figure 1:
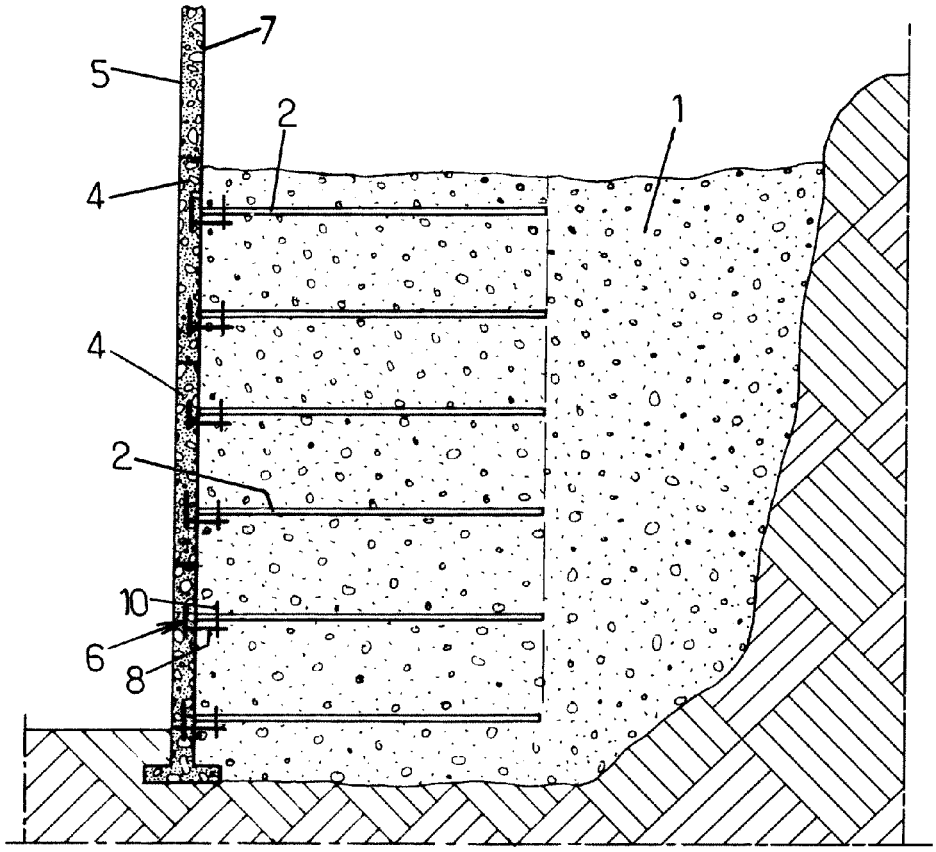
FIG. 1 is a schematic cross-sectional side view of a reinforced earth structure according to a first embodiment.

FIG. 1 represents a reinforced earth structure according to a first embodiment. This reinforced earth structure may be a retaining wall of reinforced earth.

The reinforced earth structure represented in FIG. 1 comprises backfill 1, facings 4 placed along the front face of the structure, and stabilization elements 2.

Stabilization elements intended for use in reinforced earth structures according to the invention generally comprise longitudinal portions that are elongated in shape. Their length can range from about a meter to several meters. The longitudinal portions of the stabilization elements may be placed in the earth one by one or may be assembled together by various means. The width and thickness of these longitudinal portions are on the order of a centimeter and generally do not exceed ten centimeters or so. The spacing between the longitudinal portions is about ten centimeters, ranging between a few centimeters and several decimeters.

The longitudinal portions may be placed so they are substantially parallel or may be placed at an angle. In general, the longitudinal portions of the stabilization elements are arranged in a substantially horizontal plane.

In one embodiment, the stabilization elements 2 can comprise crosspieces 22 joining the longitudinal portions. The crosspieces 22 may be welded to the longitudinal portions or may be movably attached.

For example, each of the ends of the crosspieces may be equipped with hooks whose ends are directed inwards into the crosspieces.

"Crosspiece" is understood to mean a portion of a stabilization element which connects two longitudinal portions together. Such crosspieces consist, for example, of bars. In particular, the crosspieces are arranged so as to be substantially perpendicular to the longitudinal portions or angled relative to the direction perpendicular to the longitudinal portions.

These crossbars may be distributed along the entire length of the longitudinal bars, and in particular may be regularly spaced. For example, the spacing between two crossbars is on the order of several tens of centimeters for a ladder-shaped stabilization element. They may substantially cover the distance between the longitudinal portions or may extend for a certain distance beyond the longitudinal portions.

The metal bars used for such stabilization elements are generally steel bars. They are often cylindrical and their diameter is generally on the order of a centimeter. These bars are advantageously used because of their moderate cost.

The reinforced earth structure also comprises anchoring elements 6.

Each anchoring element comprises a projecting element 8 which projects relative to the inner face 7 of the structure and an attachment element 6.

The facing 4 can be substantially vertical, as illustrated in FIG. 1, and comprises a front face 5 substantially coinciding with the front face of the structure and a rear face opposite the front surface, said rear face substantially coinciding with the inner face 7 of the structure.

Figure 2:
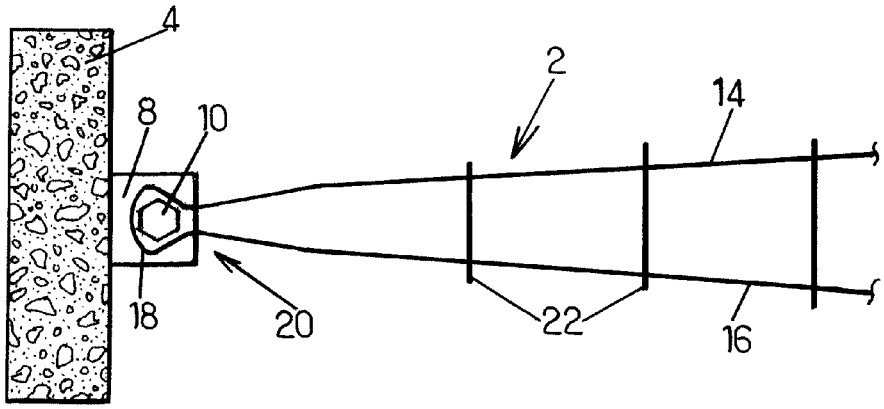
FIG. 2 is a schematic top view of the facing and of the stabilization element represented in FIG. 1.

In the embodiment illustrated in FIG. 2, the stabilization element 2 comprises two longitudinal portions 14 and 16 continuously connected together by an elbow portion 18.

Said elbow portion 18 is delimited by a neck 20 in said longitudinal portions. The neck 20 forms, together with the elbow portion 18, an anchoring space (anchoring recess) suitable for receiving the attachment element 10 of the anchoring element 6. As illustrated in FIG. 2, the anchoring space may have the shape of a keyhole.

The stabilization element 2 is anchored to the inner face 7 of the structure by placing the attachment element 10 of the anchoring element 6 in the anchoring space of the stabilization element 12.

The anchoring space and the attachment element are shaped so as to limit the movements of the stabilization element substantially parallel to the longitudinal direction of the stabilization element.

In particular, the stabilization and attachment elements are chosen so that the dimensions, in the longitudinal direction of the stabilization element, of the anchoring space of the stabilization element and of the attachment element of the anchoring element are substantially identical.

Advantageously, once the attachment element is placed in the anchoring space, the stabilization element no longer has any play or any possibility of moving in a direction substantially parallel to the longitudinal direction of the stabilization element.

As illustrated in FIG. 2, in one embodiment of the invention the stabilization element 2 is shaped so that a space is maintained between the two longitudinal portions of the stabilization element, at the neck 20.

In other words, there is no contact between the longitudinal portions of the stabilization element at the neck 20.

Advantageously, this absence of contact or the existence of this space between the two longitudinal portions of the stabilization element prevents the deposition of zinc droplets during the steps of galvanizing the stabilization elements.

In effect, as the reinforced earth structure may be in use for a long period within its environment, for example between 10 and 120 years, it may be necessary to galvanize the stabilization elements before they are placed in the structure.

In one embodiment represented in FIG. 1, the projecting element 8 of the anchoring element 6 is in the form of a plate extending in a plane substantially perpendicular to the inner face 7 of the structure.

In the invention, the attachment element 10 may be of material continuous with the projecting element 8 or may be a distinct mounted element that fits into a previously pierced hole in the projecting element 8.

For example, the attachment element 10 may be a bolt or a pin.

Figure 3:
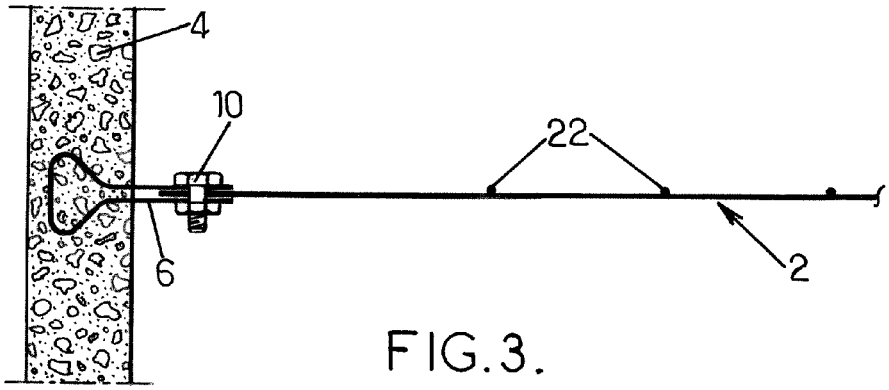
FIG. 3 is a schematic cross-sectional side view of a facing and of a stabilization element according to the invention.

In an embodiment of the invention represented in FIG. 3, the anchoring element 6 may comprise two projecting elements in the form of plates comprising corresponding holes.

The two plates lie in planes substantially parallel to each other and perpendicular to the inner face of the structure.

Figure 4A:
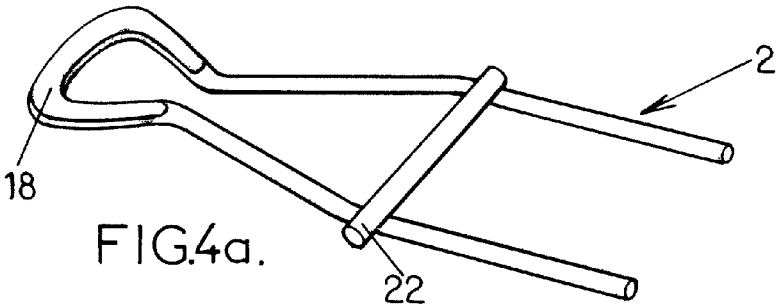
FIGS. 4*a* and 4*b* represent a stabilization element according to an embodiment of the invention.
Figure 4B:
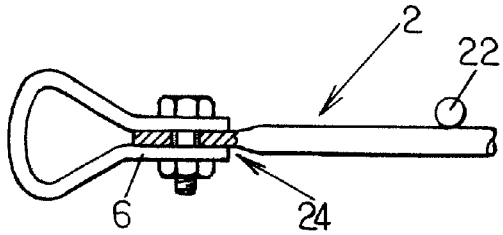

As illustrated in FIGS. 4*a* and 4*b*, the stabilization element 2 may comprise a flattened area at the anchoring space.

In the embodiment represented in FIG. 4*b*, the anchoring element comprises two projecting elements in the form of plates comprising corresponding holes.

The stabilization plate is arranged between the two plates of the anchoring element such that the anchoring area is in contact with said plates.

In another embodiment of the invention in which the projecting element 8 of the anchoring element 6 is in the form of a plate extending in a plane substantially perpendicular to the inner face 7 of the structure, the stabilization element may be arranged so that said flattened area is at least partially in contact with said plate.

Advantageously, the contact between the flattened area at the anchoring space of the stabilization element and the projecting element allows reducing or preventing corrosion ingress in the stabilization element where this contact occurs.

The invention is not limited by the shape of the anchoring element; in particular, the anchoring element may comprise two plates forming an L which projects relative to the inner face of the structure, or one pear-shaped plate as illustrated in FIG. 3.

In one embodiment of the invention, not represented, the facing may be made based on a metal mesh to which the anchoring element 6 is attached.

In an embodiment represented in FIG. 4, the reinforced earth structure according to the invention may be a reinforced earth structure in front of a preexisting wall. In this embodiment, the wall can represent an inner face of the structure of reinforced earth and may comprise anchoring elements 32 which project relative to said wall.

The anchoring elements and the stabilization elements can be those described relative to the embodiments described above.

Figure 5:
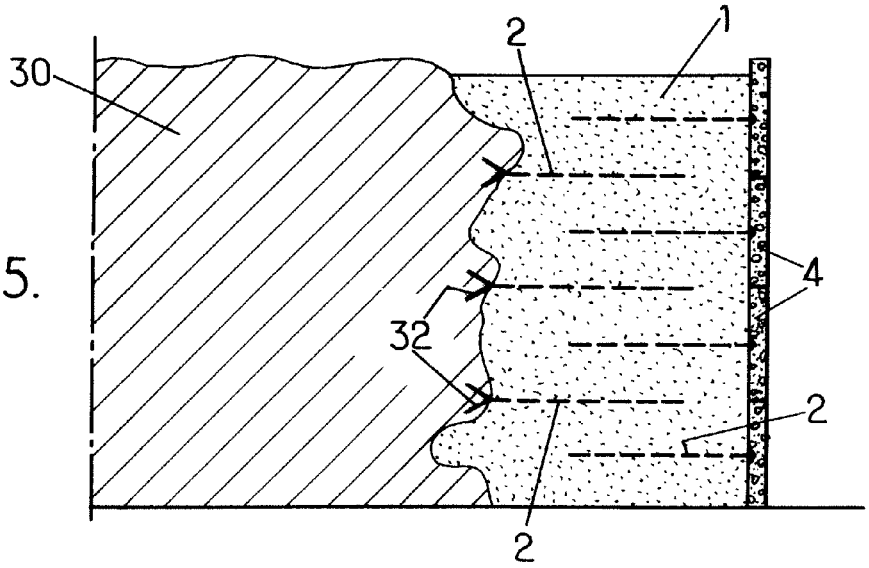
FIG. 5 is a schematic cross-sectional side view of a reinforced earth structure according to a second embodiment.

In one embodiment, the stabilization elements can be anchored to several inner faces of the structure. For example, in the embodiment in FIG. 5, the stabilization elements can be anchored to the inner face defined by the facing and to the inner face defined by the wall.

The stabilization elements of the invention may be obtained by a method comprising the following steps:

bending a metal bar into a hairpin shape to form the elbow portion, warm forging to form the neck, and possibly welding the crosspieces.

The stabilization elements of the invention may also be obtained by a method comprising the following steps:

folding two steel bars to 90° at their ends, butt welding two metal bars bent in this manner, warm forging to shape the neck and to anneal the steel around the welding point, and possibly welding the crosspieces.

It is understood that the invention is not limited to the specific embodiments described above; many variants are conceivable which fall within the scope defined by the included claims. In particular, the manner in which the anchoring element is fastened to the facing and/or to the wall is not limited to the embodiments described.

What is claimed is:

1. A reinforced earth structure, comprising:

backfill, a facing placed along the front face of the structure, an anchoring element including a projecting element which projects relative to an inner face of the structure and an attachment element, and a stabilization element including at least two longitudinal portions continuously connected together by an elbow portion, said elbow portion being delimited by a neck in said longitudinal portions, said neck forming, together with said elbow portion, an anchoring space suitable for receiving the attachment element of the anchoring element, wherein:

the stabilization element is anchored to said inner face of the structure by placing the attachment element of the anchoring element in the anchoring space of the stabilization element, and the anchoring space and the attachment element being shaped so as to limit the movements of the stabilization element in any direction substantially parallel to the longitudinal direction of the stabilization element, wherein the stabilization element comprises crosspieces connecting the two longitudinal portions together.

2. The reinforced earth structure according to claim 1, wherein the stabilization and attachment elements are configured so that the dimensions, in the longitudinal direction of the stabilization element, of the anchoring space of said stabilization element and of the attachment element of the anchoring element are substantially identical.

3. The reinforced earth structure according to claim 1, wherein a space exists at the neck between said longitudinal portions of the stabilization element.

4. The reinforced earth structure according to claim 1, wherein the projecting element is in the form of a plate extending in a plane substantially perpendicular to the inner face of the structure.

5. The reinforced earth structure according to claim 4, wherein the stabilization element comprises a flattened area at the anchoring space, said flattened area being at least partially in contact with the plate forming the projecting element.

6. The reinforced earth structure according to claim 1, wherein the attachment element is distinct mounted part.

7. The reinforced earth structure according to claim 1, wherein the projecting element comprises two plates extending in planes substantially parallel to each other and perpendicular to the inner face of the structure, the stabilization element comprising a flattened area at the anchoring space, said flattened area being arranged between the two plates of the projecting element so as to be at least partially in contact with said plates.

8. A method for constructing a reinforced earth structure, wherein:

a facing is placed along a front face of the structure, delimiting a volume to be filled in, said facing including an anchoring element comprising a projecting element which projects relative to the rear face of the facing and an attachment element, a stabilization element is placed within an area of said volume, the stabilization element comprising at least two longitudinal portions continuously connected together by an elbow portion, said elbow portion being delimited by a neck in said longitudinal portions, said neck forming, together with said elbow portion, an anchoring space suitable for receiving the attachment element of the anchoring element, the stabilization element is anchored to the facing by placing the attachment element of the anchoring element in the anchoring space of the stabilization element, backfill material is placed within said volume and the backfill material is compacted, the anchoring space and the attachment element being shaped so as to limit the movements of the stabilization element in any direction substantially parallel to the longitudinal direction of the stabilization element, wherein the stabilization element comprises crosspieces connecting the two longitudinal portions together.

9. A method for constructing a reinforced earth structure in front of a preexisting wall including an anchoring element comprising a projecting element which projects relative to said wall and an attachment element, wherein:

a facing is placed along a front face of the structure, delimiting a volume to be filled in, a stabilization element is placed within an area of said volume, the stabilization element comprising at least two longitudinal portions continuously connected together by an elbow portion, said elbow portion being delimited by a neck in said longitudinal portions, said neck forming, together with said elbow portion, an anchoring space suitable for receiving the attachment element of the anchoring element, the stabilization element is anchored to the wall by placing the attachment element of the anchoring element in the anchoring space of the stabilization element, backfill material is placed within said volume and the backfill material is compacted, the anchoring space and the attachment element being shaped so as to limit the movements of the stabilization element in any direction substantially parallel to the longitudinal direction of the stabilization element, wherein the stabilization element comprises crosspieces connecting the two longitudinal portions together.

* * * * *